US007469754B2

(12) United States Patent
Landry

(10) Patent No.: US 7,469,754 B2
(45) Date of Patent: Dec. 30, 2008

(54) APPARATUS FOR SLANT DRILLING

(76) Inventor: Harold Wayne Landry, 2006 Ambassador Caffery Pkwy., Lafayette, LA (US) 70506

( * ) Notice: Subject to any disclaimer, the term of this patent is extended or adjusted under 35 U.S.C. 154(b) by 0 days.

(21) Appl. No.: 11/985,713

(22) Filed: Nov. 15, 2007

(65) Prior Publication Data

US 2008/0066968 A1 Mar. 20, 2008

Related U.S. Application Data

(63) Continuation of application No. 10/983,484, filed on Nov. 8, 2004, now abandoned.

(51) Int. Cl.
*E21B 7/08* (2006.01)

(52) U.S. Cl. ..... 175/85; 173/185; 414/22.56

(58) Field of Classification Search ..... 175/85; 173/185; 414/22.53, 22.56, 22.55
See application file for complete search history.

(56) References Cited

U.S. PATENT DOCUMENTS 3,994,350 A * 11/1976 Smith et al. ..... 175/85
4,951,759 A * 8/1990 Richardson ..... 175/85
5,794,723 A * 8/1998 Caneer et al. ..... 175/85
6,860,337 B1 * 3/2005 Orr et al. ..... 173/28

* cited by examiner

*Primary Examiner*—Jennifer H Gay
*Assistant Examiner*—Daniel P Stephenson
(74) *Attorney, Agent, or Firm*—Ted M. Anthony

(57) ABSTRACT

A rig for drilling wells or holes at virtually any angle, from nearly horizontal to vertical, has a trailer mounted derrick which can be tilted to a desired angle, a top drive unit slidably mounted within such derrick and a hydraulic jacking apparatus. An automated pipe handling apparatus permits efficient transfer of pipe sections from the derrick to a truck, pipe rack or other storage facility.

20 Claims, 6 Drawing Sheets

APPARATUS FOR SLANT DRILLING

CROSS REFERENCES TO RELATED APPLICATIONS

This application is a continuation of U.S. Non-Provisional patent application Ser. No. 10/983,484, filed Nov. 8, 2004, now abandoned.

STATEMENTS AS TO RIGHTS TO INVENTIONS MADE UNDER FEDERALLY SPONSORED RESEARCH AND DEVELOPMENT

None

BACKGROUND OF THE INVENTION

1. Field of the Invention

The present invention relates to a rig which can efficiently and economically drill wells at virtually any angle, from nearly horizontal to vertical. More particularly still, the present invention relates to a rig which can efficiently and economically drill wells, including deviated or high angle wells, with less pipe stress and impact on the surrounding environment than conventional drilling rigs.

2. Description of the Prior Art

Many wells, such as oil and/or gas wells are drilled vertically into the earth's crust. However, it is frequently beneficial to drill wells at an angle from vertical. Such "deviated" wells are often drilled from a single surface location towards one or more subsurface targets which are situated some lateral distance away from said surface location. In many cases, such deviated wells are intentionally oriented to penetrate one or more subterranean formations at a desired angle from vertical.

Frequently, wells are drilled vertically at the earth's surface, and thereafter deviated in a different direction—that is, a desired angle from vertical—at some point down-hole. In other situations, it is often desirable to drill a deviated well at an angle from vertical starting at or very near the earth's surface. Specialized slant rigs have been developed for such wells. Unlike standard drilling rigs which typically have fixed vertical derricks, such specialized slant rigs have derricks which can be tilted from vertical. Most existing slant rigs can tilt from horizontal to approximately 30 degrees, or from vertical to about 45 degrees. However, such existing rigs cannot slant at virtually any angle between 0 and 90 degrees—that is, from nearly horizontal to vertical.

Such conventional slant rigs suffer from a number of shortcomings. Most notably, such rigs do not have lifting, pulling or pushing capacity comparable to standard drilling rigs having stationary, vertical derricks. As a result, such conventional slant rigs are not able to drill deep wells, and/or wells that have a significant lateral component.

Thus, it is an object of the present invention to provide a rig that can drill deviated wells at an angle from vertical. It is yet another object of the present invention to provide a rig having significant lifting capacity that can drill deviated wells to depths which are comparable to those drilled by standard larger capacity drilling rigs.

SUMMARY OF THE INVENTION

The rig of the present invention can be used to drill, complete, re-complete, work over and/or plug and abandon many different types of wells, from vertical wells to deviated or horizontal wells. Although the slant rig of the present invention is described herein primarily in connection with the drilling of oil and gas wells and related activities, it is to be observed that the rig of the present invention can also be beneficially utilized to drill water wells environmental monitoring wells and/or other wellbores, as well as directional holes for pipelines, utility lines and the like.

The present invention comprises a rig having a derrick which can tilt at virtually any angle from nearly horizontal to vertical. A device, commonly known as a "top drive" unit, can be selectively raised and lowered within such derrick. Said top drive unit can include upper slips for gripping the outer surface of a section of pipe, as well as a power swivel, or similar device (such as a power rotary) for rotating or spinning such pipe about its longitudinal axis when gripped within the slips of said top drive unit, a section of pipe can be raised or lowered within a derrick. Said top drive unit also permits communication of fluid into the inner flow path of a section of pipe secured within said top drive unit.

A jack apparatus is mounted within said derrick, ideally near the base of said derrick. Although said jack apparatus can utilize any number of power sources, in the preferred embodiment of the present invention, said jack apparatus includes one or more hydraulic cylinders which can extend or collapse within said derrick. Further, said jack apparatus includes at least one set of slips for gripping the outer surface of a section of pipe, as well as means for spinning or rotating said pipe about its longitudinal axis while it is being held within said jack apparatus. In the preferred embodiment, said jack apparatus has two independent sets of slips and significantly greater lifting capacity than the top drive apparatus/derrick of the present invention. When required to hold, push, drill or pull weight into a well, said jack apparatus can be used either in connection with, or in place of, the top drive unit which is mounted within said derrick. Further, pipe held within said jack apparatus can be rotated independently from pipe held within said top drive unit.

In the preferred embodiment of the present invention, an automated pipe handling apparatus is also provided which permits efficient transfer of pipe sections from said derrick (and jack apparatus) to a truck, pipe rack or other storage facility. As a result of such automated pipe handling apparatus, the labor requirement associated with loading and unloading pipe is substantially less than labor requirements associated with conventional drilling rigs. Safety is also greatly improved as a result of such automated pipe handling apparatus since it is generally not necessary to position personnel within the derrick. Additionally, less personnel are required on the rig floor compared to standard rigs.

The slant rig of the present invention can be trailer-mounted for easy transportation to and from well sites using standard trucks. Similarly, the various components of said rig including, without limitation, mud tanks, pumps, control equipment and crew quarters, can also be skid, track truck-mounted. As a result, said components can be efficiently and economically transported to and from well sites. Said components can also be quickly mobilized at a desired drilling location, and thereafter demobilized upon completion of operations.

In certain situations, it may also be beneficial to mount the slant rig of the present invention (regardless of whether or not said rig and related components are skid, track or truck-mounted) on a hovercraft or other similar device. Because the slant rig of the present invention has a relatively small "footprint", it has space requirements that are significantly less than those of conventional drilling rigs. Hovercrafts, which are capable of traveling on an air cushion above the surface of land or water, permit the slant rig of the present invention to access areas, including environmentally sensitive areas, without significant disturbance to the ground or mud-line. Such impact is reduced both while the rig of the present invention is working on location, as well as during the period that it is being transported to and from such location.

DETAILED DESCRIPTION OF A PREFERRED EMBODIMENT

Figure 1:
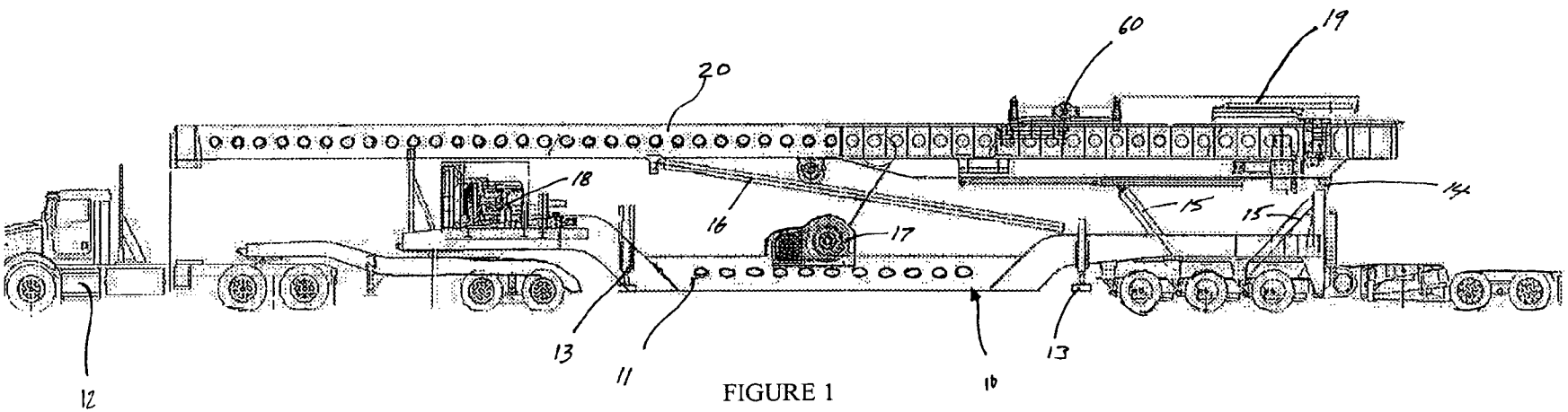
FIG. 1 depicts a side view of a trailer-mounted slant rig of the present invention with the derrick in a fully tilted, horizontal position.

Referring to the drawings, FIG. 1 depicts a side view of slant rig 10 of the present invention. In the preferred embodiment of the present invention, slant rig 10 is mounted on trailer 11. Trailer 11 can in turn be attached to, and pulled by, tractor 12. In this configuration, slant rig 10 can be easily and conveniently transported to and from desired locations. Derrick 20 is mounted on trailer 11. Adjustable trailer pedestals 13 can be used to provide additional support and stability to trailer 11, especially when said trailer 11 is rigged up at a desired work site.

In the preferred embodiment, derrick 20 can be tilted about a horizontal pivot axis passing through pin 14. During transportation of slant rig 10, derrick 20 is frequently in a collapsed or horizontal position on trailer 11. Hydraulic cylinders 15 can be used to lift derrick 20 and thereby tilt said derrick about pivot pin 14. More specifically, hydraulic cylinders 15 can be extended or collapsed to position derrick 20 at a desired angle between 0 and 90 degrees, that is, between horizontal and vertical orientation. Similarly, adjustable support 16 is provided to give additional support to derrick 20 when it is raised to a desired angle from a horizontal position. Winch 17 can also be used, in connection with pulley mechanisms to raise and lower equipment within derrick 20. Hydraulic powerpack 18 is mounted on trailer 11 to provide power to the components of slant rig 10.

Automated pipe handling apparatus 60 of the present invention is mounted to derrick 20. Adjustable work platform 19 is also mounted to derrick 20 near the base of said derrick 20. In the preferred embodiment, automated pipe handling apparatus 60 is slidably mounted to derrick 20, and adjustable work platform 19 provides a substantially horizontal work deck or rig floor which can be used during drilling operations. Said adjustable work platform 19 can be set in a horizontal orientation regardless of the angle of derrick 20. Although not specifically depicted in the drawings, it is to be observed that slant rig 10 of the present invention will frequently include other equipment or components that are usual and customary on conventional drilling rigs. For example, slant rig 10 of the present invention may include mud tanks, mud pumps, shale shakers, control equipment, crew quarters, and the like. In the preferred embodiment, such components are also ideally modular in construction and trailer-mounted for easy transportation, as well as mobilization and demobilization at a well site.

Figure 2:
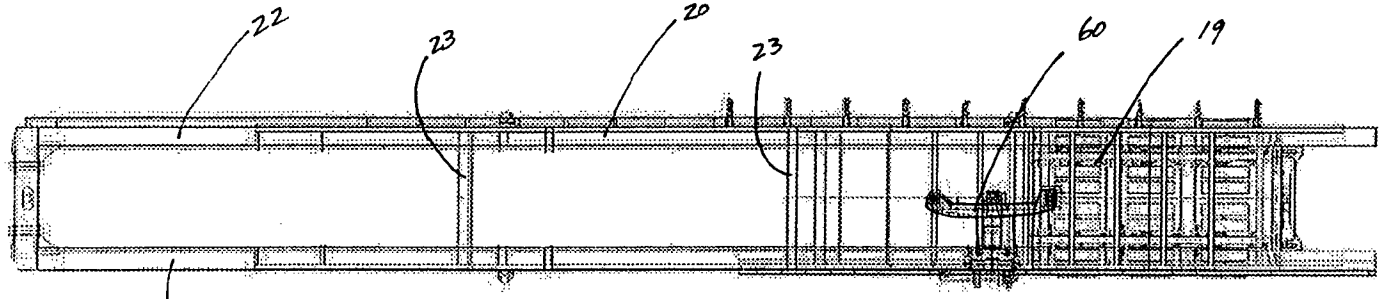
FIG. 2 depicts an overhead view of a derrick of the present invention in the fully tilted, horizontal position (not including pipe handling apparatus and top drive unit).

FIG. 2 depicts an overhead view of derrick 20 of the present invention in a horizontal orientation, such as during transportation to or from a well site. Although derrick 20 can be constructed in any number of different configurations, in the preferred embodiment derrick 20 comprises parallel rails 21 and 22. Cross members 23 provide added strength to derrick 20. In the configuration depicted in FIG. 2, work platform 19 is collapsed against derrick 20 while slant rig 10 of the present invention is being transported. Similarly, automated pipe handling apparatus 60 of the present invention is also collapsed against derrick 20 in FIG. 2. In the preferred embodiment of the present invention, derrick 20 can be telescopically extended to increase the overall length of said derrick. Thus, although derrick 20 of the present invention is depicted in a collapsed or retracted configuration, it is to observed that derrick 20 can also be telescopically extended to increase the overall length of derrick 20.

Figure 3:
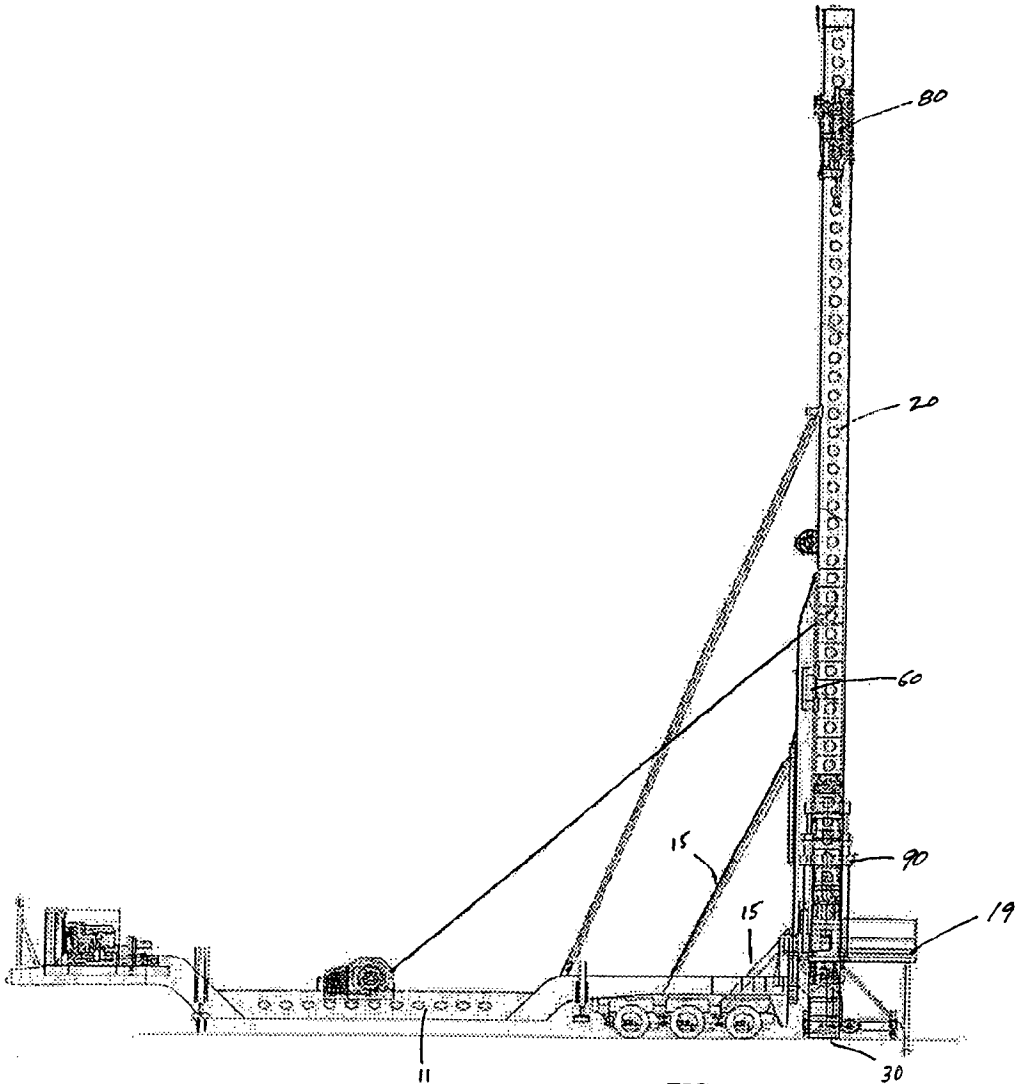
FIG. 3 depicts a side view of a trailer-mounted slant rig of the present invention with the derrick in a vertical position.

FIG. 3 depicts a side view of slant rig 10 of the present invention in a fully rigged-up configuration over well 30. During mobilization, trailer 11 is transported to, and positioned at, a desired work location. Derrick 20 of the present invention is oriented in an upright vertical position over well 30 using hydraulic cylinders 15. When derrick 20 is in such an upright vertical position, hydraulic cylinders 15 are in a fully extended position. Adjustable support member 16 provides added support to derrick 20 and serves to maintain its stability.

Still referring to FIG. 3, derrick 20 of the present invention is telescopically extended to increase its overall length. Further, work platform 19 is deployed to provide a substantially horizontal work platform or rig floor for use in connection with slant rig 10. Said work platform 19 can be used to provide a platform for rig personnel to work during drilling operations. Top drive apparatus 80 is slidably mounted within derrick 20, while jack apparatus 90 is mounted near the base of derrick 20 in general proximity to well 30. Automated pipe handling apparatus 60 is mounted within derrick 20, although said jack apparatus is partially obscured from view in FIG. 3.

Figure 4:
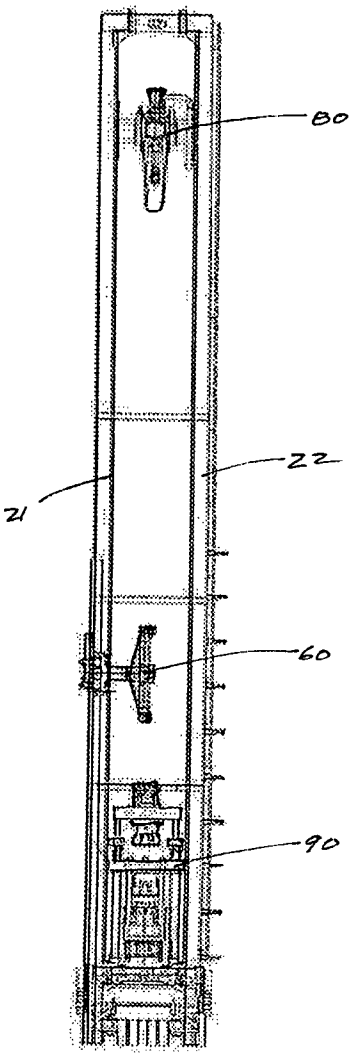
FIG. 4 depicts an end view of a trailer-mounted slant rig of the present invention with the derrick in a vertical position.

FIG. 4 depicts an end view of slant rig 10 of the present invention in the same basic configuration shown FIG. 3. Derrick 20 having parallel rails 21 and 22, as well as cross members 23, is in a fully upright, vertical position. Further, derrick 20 is telescopically extended to a desired length. In most cases, during operation such length is greater than the length of derrick 20 when said derrick is collapsed, such as during transportation. Although generally obstructed from clear view in FIG. 3, FIG. 4 depicts automated pipe handling apparatus 60, top-drive apparatus 80 and jack apparatus 90 installed within derrick 20.

Figure 5:
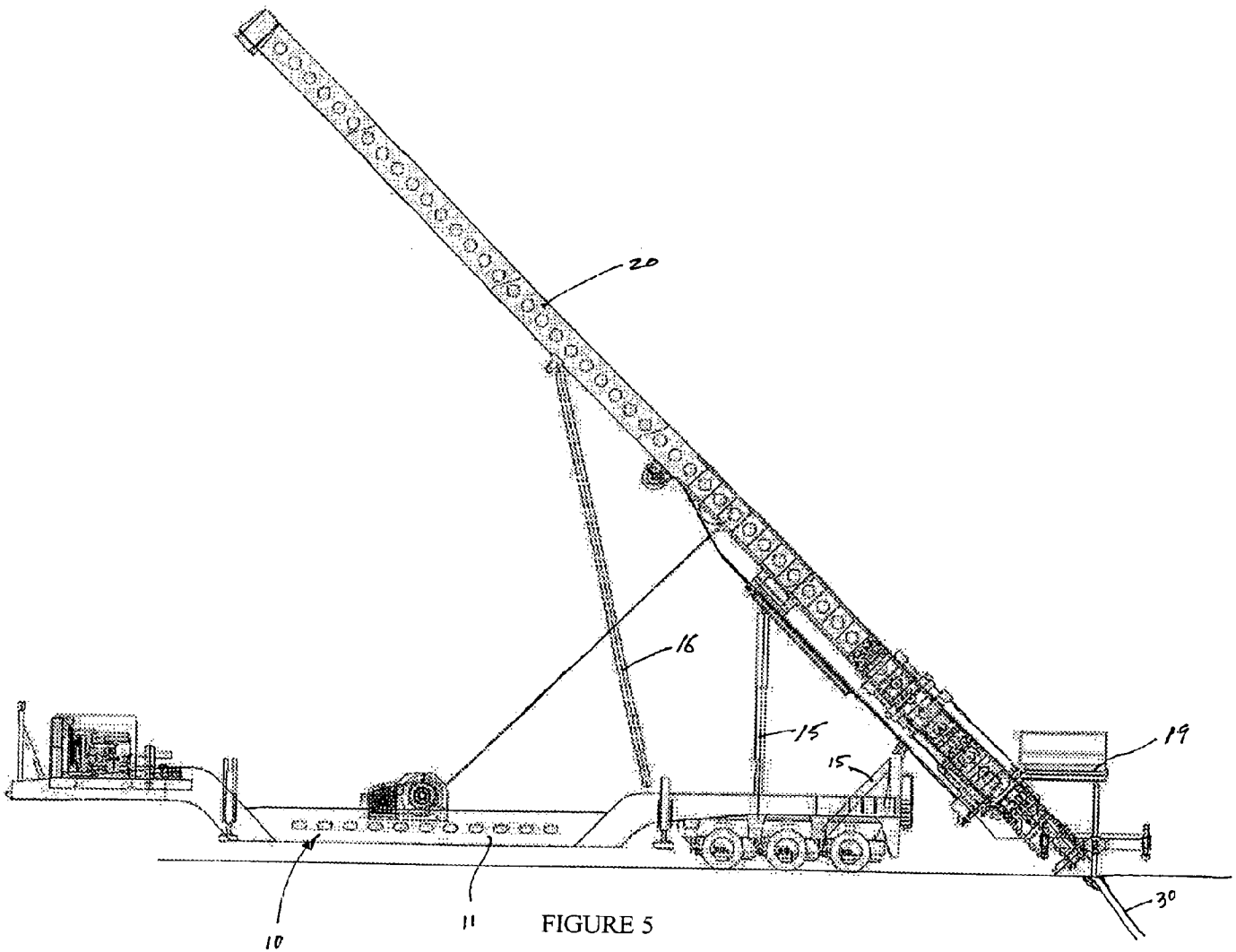
FIG. 5 depicts a side view of a trailer-mounted slant rig of the present invention with the derrick at an angle between horizontal and vertical.

FIG. 5 depicts a side view of slant rig 10 of the present invention in a fully rigged-up configuration. During mobilization, trailer 11 is transported and positioned at a desired work location over well 30. Derrick 20 of the present invention is oriented in a slant or angled position; said orientation of derrick 20 is at an acute angle, wherein said derrick 20 is at a desired angle between horizontal and vertical. Said derrick 20 is oriented at the desired angle using hydraulic cylinders 15. When derrick 20 is in the desired position, adjustable support member 16 is used to provide added support to derrick 20 and serves to maintain the stability of said derrick 20. Work platform 19 is deployed to provide a substantially horizontal work platform or rig floor for slant rig 10 even when derrick 20 is oriented at a slant as in FIG. 5. Said work platform 19 can be used to provide a platform for rig personnel to work during drilling operations.

Figure 6:
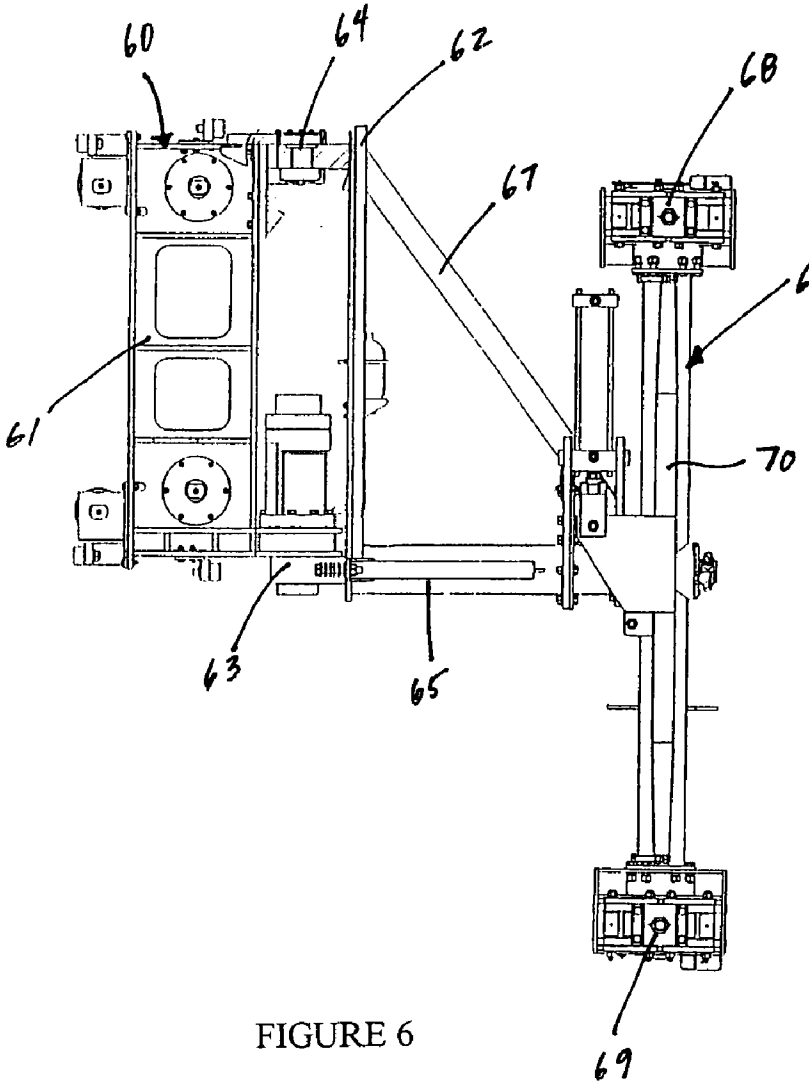
FIG. 6 depicts a side view of an automated pipe handling apparatus of the present invention.

FIG. 6 depicts a side view of automated pipe handling apparatus 60 of the present invention. Automated pipe handling apparatus of the present invention includes bracket apparatus 61. In the preferred embodiment, said bracket apparatus 61 is slidably mounted to derrick 20 of the present invention. In the preferred embodiment, bracket apparatus 61 can slide along rail 21 of derrick 20, or a track mounted thereto, and travel along a portion of the length of said derrick 20.

Mounting plate 62 is pivotally attached to bracket apparatus 61 via lower swivel apparatus 63 and upper pivot pin 64. Said mounting plate 62 can pivot relative to bracket apparatus 61 about a pivot axis passing through said lower swivel apparatus 63 and upper pivot pin 64. Cantilever arm 65 extends outward from Mounting plate 62. Pipe gripper apparatus 66 is attached to the distal end of cantilever arm 65. Bracing member 67 extends from mounting plate 62 to pipe gripper apparatus 66, and provides structural reinforcement to cantilever arm 65 and pipe gripper apparatus 66. Pipe gripper apparatus 66 includes post 70, as well as upper pipe gripper 68 mounted to the upper end of post 70, and lower pipe gripper 69 mounted to the lower end of post 70.

Figure 7:
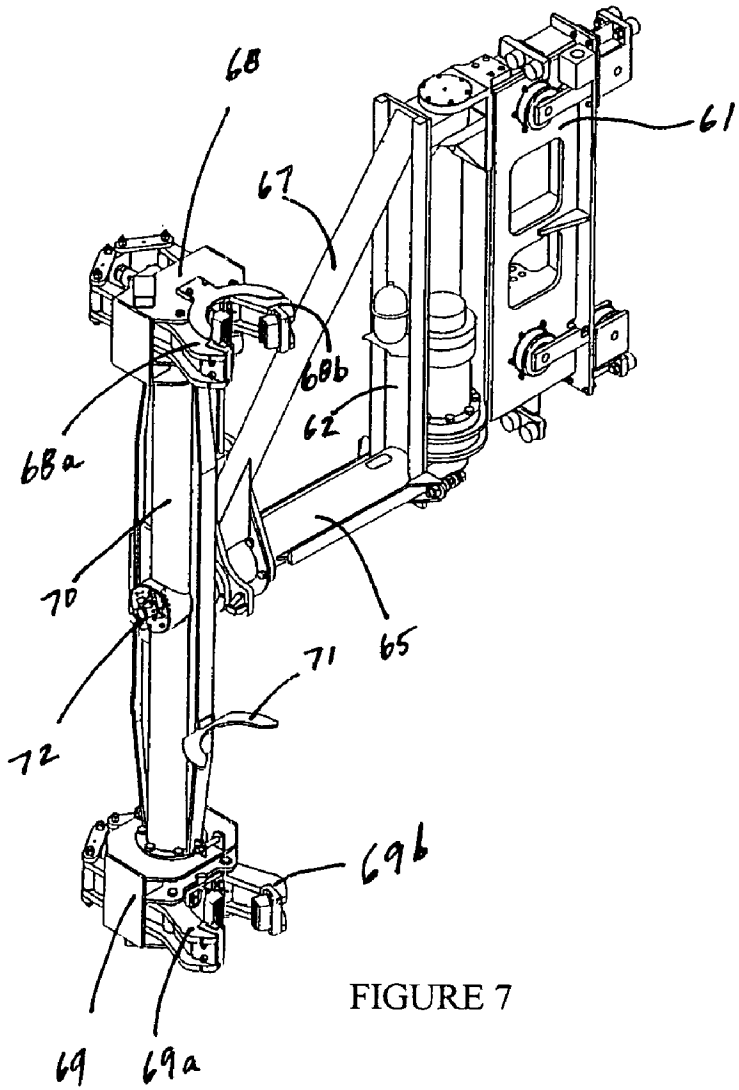
FIG. 7 depicts an overhead perspective view of the automated pipe handling apparatus of the present invention.

Referring to FIG. 7, upper pipe gripper 68 is connected to the upper extent of post 70, while lower pipe gripper 69 is connected to the lower extent of post 70. Upper pipe gripper 68 comprises opposing arcuate jaws 68*a* and 68*b*. Similarly, lower pipe gripper 69 comprises opposing arcuate jaws 69*a* and 69*b*. Post 70 is mounted to cantilever arm 65 via swivel apparatus 72. Said post 70 can rotate about an axis passing through cantilever arm 65. Cradle 71 is mounted to post 70 and provides a base for receiving a section of pipe.

In operation, automated pipe handling apparatus 60 of the present invention can be used to transfer pipe into derrick 20 from a waiting truck, pipe rack or other pipe storage device. Similarly, automated pipe handling apparatus 60 can be used to transfer pipe out of said derrick 20, and load such pipe into a waiting truck, pipe rack or other pipe storage device. Pipe handling apparatus 60 can be positioned along the length of derrick 20 using traveling bracket apparatus 61.

Figure 8:
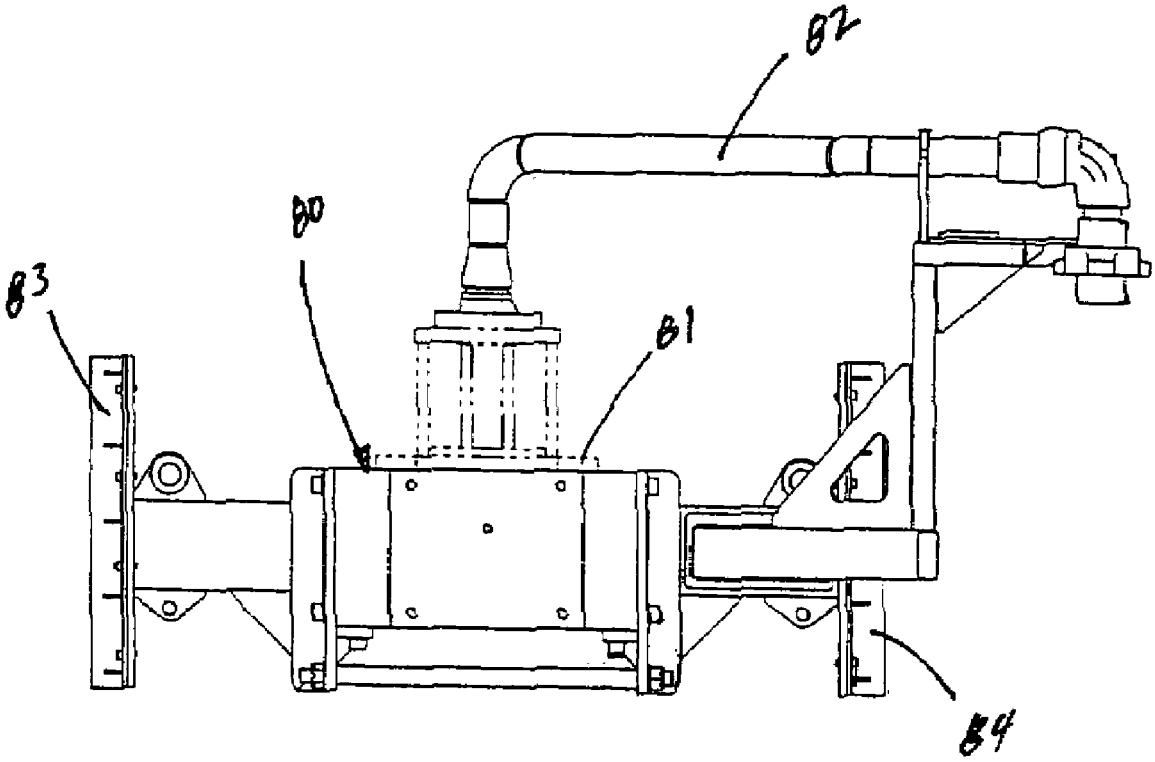
FIG. 8 depicts a side view of a top drive apparatus of the present invention.

FIG. 8 depicts side view of top drive apparatus 80 of the present invention. Top drive apparatus 80 comprises swivel mechanism 81, and fluid connection line 82. Said top drive apparatus can be raised and lowered within derrick 20 via slidable mounting brackets 83 and 84. Internal slips (not shown in FIG. 8) allow top drive assembly 80 to grip the outer surface of a section of pipe. When a section of pipe is connected to top drive assembly 80 within derrick 20 of the present invention, said pipe can be rotated using swivel mechanism 81, while fluid can flow into and out of such a section of pipe via fluid connection line 82.

Figure 9:
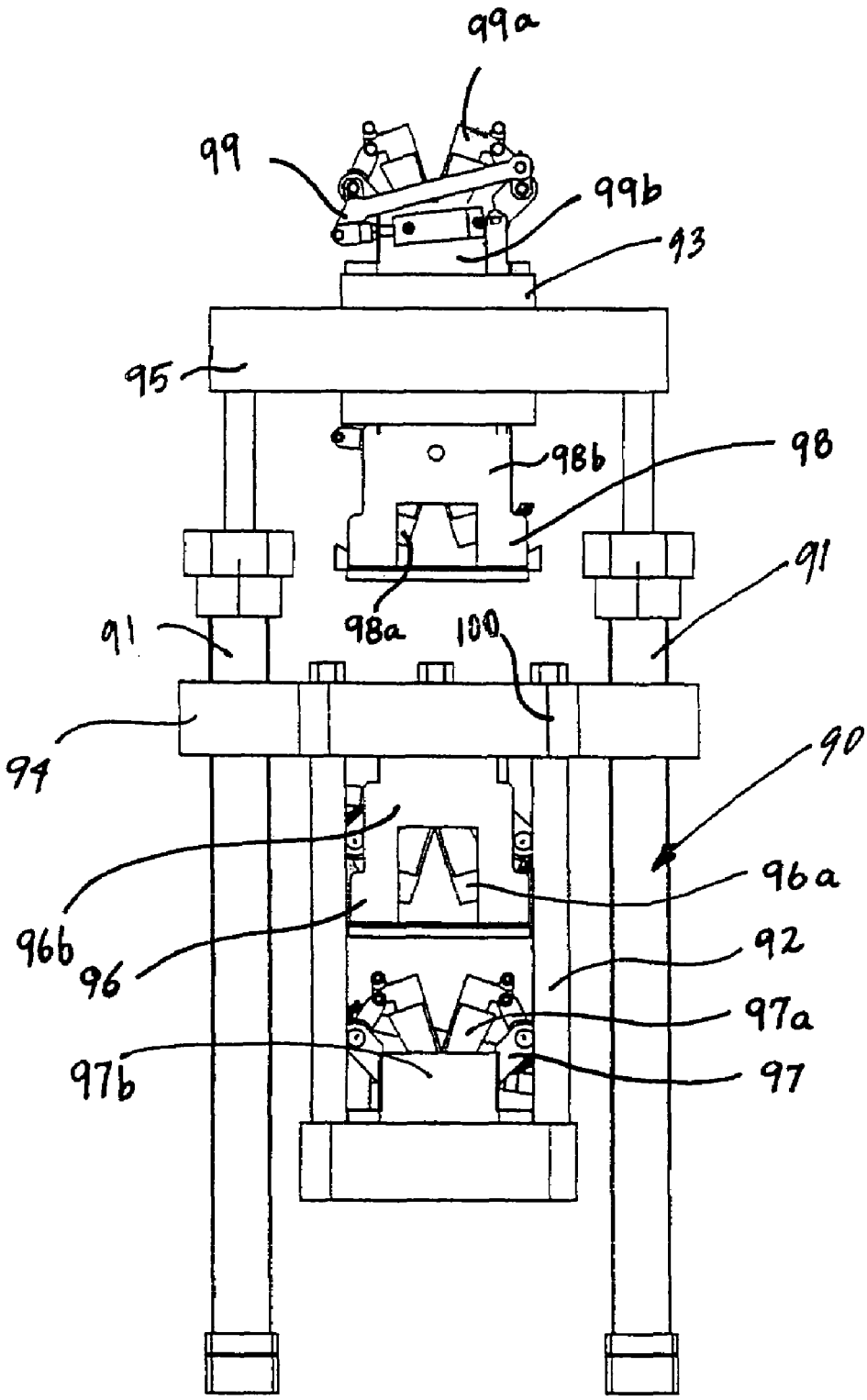
FIG. 9 depicts a side view of a jack apparatus of the present invention.

Referring to FIG. 9, jack apparatus 90 is mounted within derrick 20, ideally near the base of said derrick 20. In the preferred embodiment, said jack apparatus 90 is mounted on a wellhead, or directly on the ground. Although said jack apparatus 90 can utilize any number of power sources, in the preferred embodiment of the present invention, said jack apparatus 90 is hydraulically powered and includes a plurality of hydraulic cylinders 91, which can be extended or collapsed within derrick 20.

Specifically, jack apparatus 90 further comprises substantially stationary base member 94. Traveling jack member 95 is movably connected to said substantially stationary base 94 using hydraulic cylinders 91. In this configuration, traveling jack member 95 can be raised and lowered relative to substantially stationary base member 94 using hydraulic cylinders 91.

Further, said jack apparatus 90 comprises lower slip extension 92 rotatably attached to said substantially stationary base member 94. In the preferred embodiment, slip assembly 96 and slip assembly 97 are disposed on said lower slip extension 92 for gripping the outer surface of a section of pipe.

Such slip assemblies 96 and 97, which are well known the art, generally comprise retractable wedge-shaped slip members having curved inner surfaces and teeth-like grippers known as "dies" that correspond to the outer surface of pipe to be held within such slip members. The outer surfaces of the wedge-shaped slip members are typically tapered so that they correspond with a tapered inner surface, or "bowl."Such wedge-like slip members fit within said bowl, and essentially wrap around or surround a portion of the outer surface of pipe being gripped. Referring to FIG. 9, slip members 96*a* can fit within bowl 96*b* of slip assembly 96, while slip members 97*a* can fit within bowl 97*b* of slip assembly 97. In the preferred embodiment, both slip assembly 96 and 97 are hydraulically powered and remotely controlled.

In the preferred embodiment, slip assemblies 96 and 97 oppose one another. As such, said slip assemblies 96 and 97 can support loading in opposite directions. Specifically, slip assembly 97 can support loading in a generally downward direction; thus, said slip assembly 97 can support the weight of pipe gripped by said slip assembly 97. Conversely, slip assembly 96 can support loading in a generally upward direction.

In the preferred embodiment, lower slip assembly 92 is connected to a power swivel or other similar device, such as a powered rotary 100, that is disposed on substantially stationary base member 94. Said powered rotary 100 can be used to rotate lower slip assembly 92; as such, powered rotary 100 can be used to spin or rotate pipe held within slip assembly 96 or slip assembly 97 of lower slip assembly 92 about the longitudinal axis of said pipe.

Slip assembly 98 and slip assembly 99 are disposed on said traveling jack member 95 for gripping the outer surface of a section of pipe. Referring to FIG. 9, slip members 98*a* can fit within bowl 98*b* of slip assembly 98, while slip members 99*a*can fit within bowl 99*b* of slip assembly 99. In the preferred embodiment, both slip assembly 98 and 99 are hydraulically powered and remotely controlled.

In the preferred embodiment, slip assemblies 98 and 99 oppose one another. As such, said slip assemblies 98 and 99 can support loading in opposite directions. Specifically, slip assembly 99 can support loading in a generally downward direction; thus, said slip assembly 99 can support the weight of pipe gripped by said slip assembly 99. Conversely, slip assembly 98 can support loading in a generally upward direction, such as when pipe is being pulled out of a well using traveling jack member 95.

A power swivel or other similar device, such as a powered rotary 93, is disposed on traveling jack member 95. Said powered rotary 93 can be used to rotate slip assemblies 98 and 99; as such, powered rotary 93 can be used to spin or rotate pipe held within slip assembly 98 or slip assembly 99 about said pipe's longitudinal axis.

In the preferred embodiment, said jack apparatus 90 has significantly greater lifting capacity than the top drive apparatus 80 and/or derrick 20 of the present invention. As a result, when required to hold, push, drill or pull weight into or out of a well, said jack apparatus 90 can be used either in connection with, or in place of, said top drive unit which is mounted within said derrick.

Because said jack apparatus 90 is not mounted directly to derrick 20, it is capable of lifting, pulling, pushing or otherwise manipulating pipe independently from derrick 20. In other words, the lifting, pulling, pushing or other strength capacity of said jack apparatus 90 is not limited by the capacity of said derrick 20 or top drive apparatus 80 mounted within said derrick. As such, said jack apparatus has significantly greater strength capacity than a slant rig which is not equipped with such jack apparatus.

Because both top drive unit 80 and jack apparatus 90 are capable of gripping pipe and rotating such pipe, it is possible to simultaneously drill one size pipe concentrically within another size pipe. As a result the slant rig 10 of the present invention is far more versatile than conventional rigs. For example, slant rig 10 of the present invention can be used to simultaneously drill well casing using jack apparatus 90, and tubing or drill pipe concentrically through such casing using top drive unit 80.

As set forth above, in certain applications it may also be beneficial to mount or dispose slant rig 10 of the present invention (regardless of whether or not said rig and related components are skid, track or truck-mounted) on a hovercraft, barge or other similar device. Because slant rig 10 of the present invention has a relatively small "footprint", it has space requirements that are significantly less than those of conventional drilling rigs. Hovercrafts, which are capable of traveling on an air cushion above the surface of land or water, permit the slant rig of the present invention to access areas, including environmentally sensitive areas, without significant disturbance to the ground or mud-line. Such impact is reduced both while the rig of the present invention is working on location, as well as during the period that it is being transported to and from such location.

The above disclosed invention has a number of particular features which should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention

What is claimed:

1. A drilling rig comprising:

a. a derrick having a length, wherein said derrick can be tilted at any angle between 0 and 90 degrees from vertical;

b. a top drive unit slidably mounted to said derrick; and c. a jack disposed at the base of said derrick having a stroke parallel to the longitudinal axis of said derrick, wherein said jack can support, push and pull weight independently from said derrick and top drive, and further comprises:

i. means for connecting said jack directly to a section of pipe; and ii. means for rotating a section of pipe connected to said jack.

2. The drilling rig of claim 1, wherein said top drive unit comprises:

a. means for connecting said top drive unit to a section of pipe;

b. means for communicating fluid in and out of said section of pipe;

c. means for rotating said section of pipe; and d. means for reciprocating said section of pipe.

3. The drilling rig of claim 2, wherein said means for connecting to a section of pipe comprises at least one set of slips.

4. The drilling rig of claim 2, wherein said means for rotating said section of pipe comprises a powered rotary.

5. The drilling rig of claim 1, wherein said jack comprises:

a. means for connecting said jack directly to a section of pipe;

b. means for rotating said section of pipe connected to said jack; and c. means for pushing or pulling said section of pipe connected to said jack.

6. The drilling rig of claim 5, wherein said means for connecting said jack directly to a section of pipe comprises at least one set of slips.

7. The drilling rig of claim 5, wherein said means for rotating said section of pipe connected to said jack comprises a powered rotary.

8. The drilling rig of claim 1, wherein said drilling rig is disposed on a trailer.

9. The drilling rig of claim 1, wherein said drilling rig is disposed on a hovercraft or barge.

10. A drilling rig comprising:

a. a base;

b. a derrick having a top, a bottom and a length, wherein the bottom of said derrick is pivotally mounted to said base, and said derrick pivots about a substantially horizontal pivot axis;

c. a top drive unit movably disposed along the length of said derrick, said top drive unit comprising:

i. means for connecting said top drive unit to a section of pipe;

ii. means for communicating fluid in and out of a section of pipe connected to said top drive unit; and iii. a powered rotary for rotating said section of pipe connected to said top drive unit; and d. a jack, disposed near the bottom of said derrick, wherein said jack can support, push and pull weight independently from said derrick and top drive, said jack comprising:

i. at least one slip assembly for directly gripping a section of pipe; and ii. at least one powered rotary for rotating a section of pipe disposed within said at least one slip assembly.

11. The drilling rig of claim 10, wherein the angle formed between said derrick and said base is an acute angle.

12. The drilling rig of claim 10, wherein said drilling rig is disposed on a trailer.

13. The drilling rig of claim 10, wherein said drilling rig is disposed on a hovercraft or barge.

14. The drilling rig of claim 10, further comprising an automated pipe handling apparatus.

15. The drilling rig of claim 14, wherein said automated pipe handling apparatus comprises means for gripping a section of pipe, positioning said pipe in alignment with said derrick and releasing said section of pipe.

16. A drilling rig comprising:

a. a base;

b. extendable derrick having a top, a bottom and an adjustable length, wherein said bottom of said derrick is pivotally mounted to said base and said derrick pivots about a substantially horizontal pivot axis;

c. at least one hydraulic cylinder having a first end and a second end, wherein said first end of said at least one hydraulic cylinder is attached to said base and said second end of said at least one hydraulic cylinder is attached to said derrick;

d. a top drive unit movably disposed along the length of said derrick, said top drive unit comprising:

i means for connecting said top drive unit to a section of pipe;

ii. means for communicating fluid in and out of a section of pipe connected to said top drive unit; and iii. a powered rotary for rotating said section of pipe;

e. a jack, disposed near said base, comprising:

i a substantially stationary base;

ii. a traveling member;

iii. a plurality of hydraulic cylinders connecting said traveling member to said substantially stationary base;

iv. a first powered rotary disposed on said traveling member;

v. at least one slip assembly connected to said first powered rotary;

vi. a second powered rotary disposed on said substantially stationary base; and vii. at least one slip assembly connected to said second powered rotary.

17. The drilling rig of claim 16, further comprising a pipe handling apparatus comprising means for gripping a section of pipe, positioning said pipe in alignment with said derrick and releasing said section of pipe.

18. The drilling rig of claim 16, wherein said drilling rig is disposed on a hovercraft or barge.

19. The drilling rig of claim 16, wherein said at least one slip assembly connected to said first powered rotary further comprises:

a. a first slip assembly, wherein said first slip assembly is oriented to support loading in a substantially downward direction; and b. a second slip assembly, wherein said second slip assembly is oriented to support loading in a substantially upward direction.

20. The drilling rig of claim 16, wherein said at least one slip assembly connected to said second powered rotary further comprises:

a. a first slip assembly, wherein said first slip assembly is oriented to support loading in a substantially upward direction; and b. a second slip assembly, wherein said second slip assembly is oriented to support loading in a substantially downward direction.

* * * * *